United States Patent [19]

Hanyu et al.

[11] Patent Number: 4,538,535

[45] Date of Patent: Sep. 3, 1985

[54] SEWING MACHINE WITH UPPER THREAD DYEING MECHANISM

[75] Inventors: Susumu Hanyu; Yoshio Yamaguchi, both of Hachioji, Japan

[73] Assignee: Janome Sewing Machine Industry Co., Ltd., Japan

[21] Appl. No.: 441,308

[22] Filed: Nov. 12, 1982

[30] Foreign Application Priority Data

Nov. 11, 1981 [JP] Japan ..... 56-179829

[51] Int. Cl.[3] ..... D05B 67/00

[52] U.S. Cl. ..... 112/270; 112/266.1; 112/79 A; 112/275

[58] Field of Search ..... 112/2, 262.1, 266.1, 112/270, 275, 79 A, 79 R, 302; 68/9, 13, 205 R; 8/479

[56] References Cited

U.S. PATENT DOCUMENTS

| | | | |
|---|---|---|---|
| 2,910,026 | 10/1959 | Ajouelo | 112/270 |
| 3,883,298 | 5/1975 | Platt | 112/262.1 X |
| 4,106,416 | 8/1978 | Blackstone, Jr. et al. | 112/79 A |
| 4,453,477 | 6/1984 | Gerber | 112/79 A X |
| 4,465,005 | 8/1984 | Eguchi et al. | 112/275 X |

*Primary Examiner*—Peter Nerbun

*Attorney, Agent, or Firm*—William A. Drucker

[57] ABSTRACT

A sewing machine is provided with an upper thread dyeing mechanism for dyeing an upper thread a given color while driving the sewing machine. An upper thread feeding mechanism is also provided for the sewing machine and operative in combination with the dyeing mechanism when a stitching operation is initiated or a change in color of the upper thread is required. A predetermined amount of the upper thread, which remains to be located on the sewing machine, is drawn out by the feeding mechanism, while being colored by the dyeing mechanism.

4 Claims, 13 Drawing Figures

SEWING MACHINE WITH UPPER THREAD DYEING MECHANISM

BACKGROUND OF THE INVENTION

The invention relates to a sewing machine equipped with an upper thread dyeing mechanism, which is able to carry out a stitching operation while selectively dyeing an upper thread with a desired color.

So far, it has been necessary to prepare so many threads of different colors as required to be used for stitching operation, especially for making pattern stitches and embroidery stitches with a sewing machine, and to selectively use these threads of different colors in dependence upon the kind of stitches. If a sewing machine operator desires to enjoy a complicated embroidery stitches requiring many different colors according to such a conventional manner, the operator is obliged to interrupt the stitching operation so as to change the sewing thread each time a different color thread is required. Such a thread changing operation comprises the steps of stopping the sewing machine, raising a material presser foot of the sewing machine, cutting off an upper thread previously used, removing the upper thread, and then providing the sewing machine with a fresh upper thread of a different color which is to be passed through a number of thread guides, a tensioning device, a thread take-up lever and a needle hole, which is considerably troublesome and time-consuming.

To eliminate such defects and disadvantages, it has been proposed that a sewing machine is provided with a dyeing mechanism by which a white or colorless upper thread is selectively dyed with any given color, while driving the sewing machine. In this case, however, there will be a time lag between when the upper thread is colored by the dyeing mechanism and when a reciprocating needle accompanied by the colored upper thread penetrates a material sewn. Accordingly, when the stitch pattern requires a change in color of the upper thread, a portion of the thread existing between the dyeing mechanism and the needle has been already colored with a previously required color and can not be used for sequential stitching operation.

SUMMARY OF THE INVENTION

It is therefore an object of the invention to provide a sewing machine, which is equipped with an upper thread dyeing mechanism for dyeing an upper thread with a desired color, while the sewing machine is driven and the upper thread is located on the sewing machine, and which is also equipped with an upper thread feeding mechanism for feeding and cutting off an unnecessary portion of the upper thread, while the upper thread is kept passing through a needle hole, said unnecessary portion of the thread being produced when changing a color thereof in accordance with a stitch pattern to be sewn.

Another object of the invention is to provide an automatic control system for smoothly operating the upper thread dyeing mechanism and the upper thread feeding mechanism, with security and saving of energy.

According to an aspect of the invention, there is provided a sewing machine comprising an upper thread dyeing mechanism for dyeing an upper thread with a given color, and an upper thread feeding mechanism operated by a switch connected to a tensioning device for releasing tension applied thereby to the upper thread while operating said feeding mechanism, so that a predetermined amount of the upper thread located on the sewing machine if drawn out by said feeding mechanism while being colored by said dyeing mechanism, said dyeing mechanism being adapted to be operated not only when the sewing machine is driving for stitching operation but also simultaneously with operation of said feeding mechanism.

BRIEF DESCRIPTION OF DRAWINGS

Further objects and advantages of the invention can be more fully understood from the following description when read in conjunction with the accompanying drawings in which.

PREFERRED EMBODIMENTS OF THE INVENTION

Figure 1:
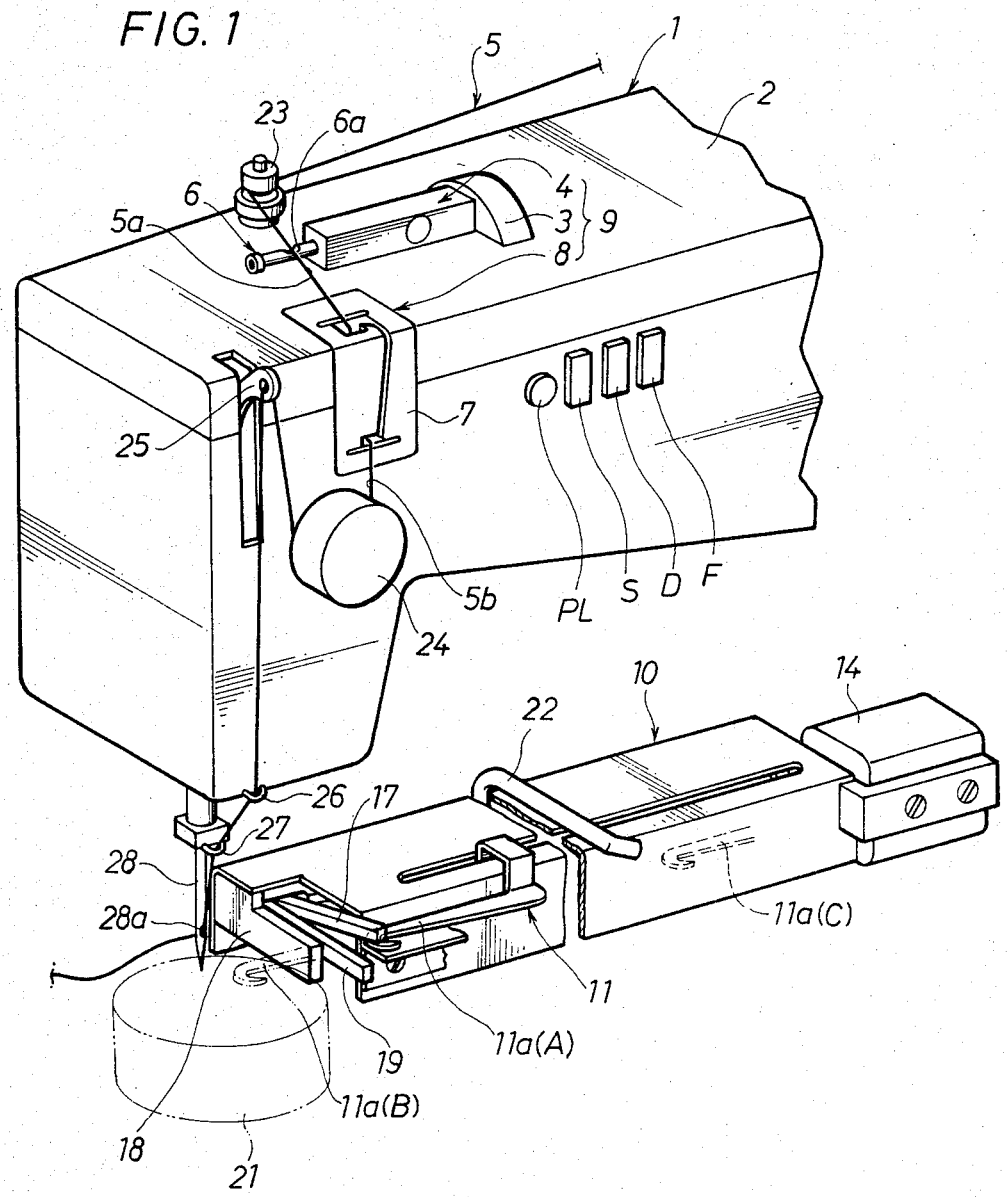
FIG. 1 is a perspective view showing a sewing machine provided with an upper thread dyeing mechanism of a first embodiment of the invention.

In the first embodiment of the invention shown in FIGS. 1–8, a coloring device 4 is detachably connected to a mount 3 provided on an upper surface of a machine housing 2 of a sewing machine 1. A running upper thread 5 of a white color is subjected to contact with a notched coloring section 6*a* of the coloring device 4 so that a dyeing liquid is applied to the upper thread. The upper thread 5 is then subjected to contact with a heat-set roller for heat-setting the dyeing liquid coated on the thread. The heat-set roller is positioned in a heat-set section 8 covered by an insulating member 7. The mount 3, detachable coloring device 4 and the heat-set section 8 constitute a dyeing mechanism 9.

When it is intended to change a color of the upper thread in accordance with a pattern to be stitched, there remains a portion of the thread which has already been subjected to contact with the previously used coloring device, which exists between the notched coloring section 6a and the reciprocating needle 28. The said portion of the thread is easily taken off in a manner as described later.

Change of the color of the thread is done by changing a coloring device 4 to a suitable one, with the embodiment shown. Alternatively, it may be possible that a plurality of coloring devices are installed on the machine housing and one of the coloring devices is selectively used.

Referring again to FIG. 1, when a set button S is pushed on condition that the sewing machine is connected to a power supply, a set switch (not shown) is turned on and a heater for the heat-set roller is also turned on. A pilot lamp PL is switched on when a temperature of the roller is elevated to a predetermined level. Operation of a thread feeding button F turns a thread feeding switch (not shown) on, so that a predetermined amount of the thread is drawn out from the thread supply to the needle, at the time of beginning the stitching operation and changing a color of the thread, as in a manner described later. Operation of a dyeing button D turns a dyeing switch (not shown) on.

Figure 2:
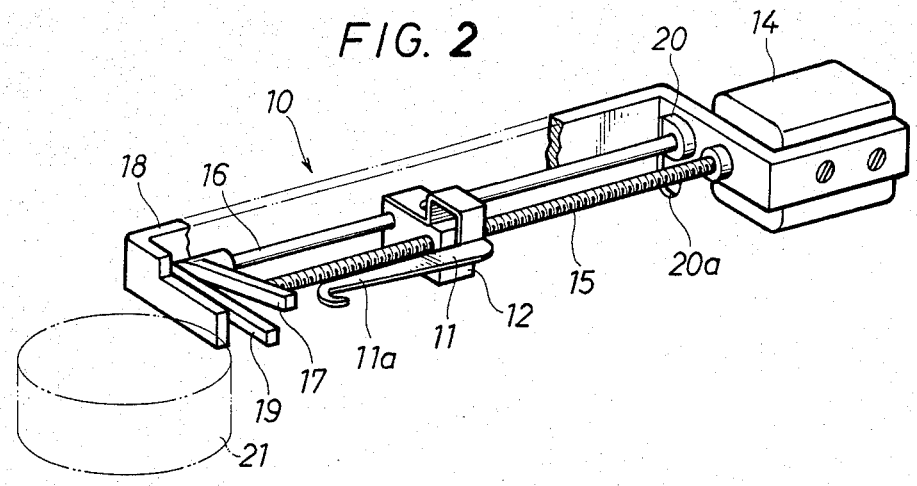
FIG. 2 is a perspective view showing an upper thread feeding mechanism provided for the sewing machine of the first embodiment shown in FIG. 1.

As shown in FIGS. 1 and 2, a thread feeding mechanism 10 is provided inside of a sewing machine bed. An axially extending hook member 11 is secured to a movable block 12, which is mounted on a threaded shaft 15 and a guide shaft 16, installed in parallel, and is moved along the guide shaft 16 by rotating the threaded shaft 15 by a motor 14. A blade 17 is secured to the end of the guide shaft 16 and is normally positioned as shown in FIG. 2 by means of a spring (not shown). A blade 19 is fixedly secured to a stationary frame 18. A hook 11a of the hook member 11 is axially slidable and adapted to pass between the blades 17 and 19. To the other end of the guide shaft 16 is secured an actuator 20 having a downwardly extending arm 20a. When the block 12 reaches this end of the shaft 16 and engages the arm 20a of the actuator 20, the guide shaft 16 and accordingly the blade 17 are caused to rotate in the clockwise direction against the force of the spring. The hook 11a is laterally moved along the guide shaft 16 and the threaded shaft 15 by the motor 14 which is energized by operation of the thread feeding button F to rotate the threaded shaft 15. Namely, as particularly shown in FIG. 1, the hook 11a is moved from an inoperative position (A) shown by a solid line to a position (B) shown by a phantom line, at which position it catches an upper thread loop formed at the needle 28, and then is moved to a rightmost position (C) for drawing out the upper thread thus caught. Thus, the hook 11a draws out a predetermined amount of the thread 5 from the thread supply to feed the same to the needle 28. At the position (C) of the hook 11a, the upper thread 5 is cut off by cooperation of the blades 17 and 19, and the cut-off portion of the thread is blown downwardly by air discharged from a nozzle 22. The hook 11a is, after such a thread cutting-off operation, automatically returned to the inoperative position (A).

Figure 3:
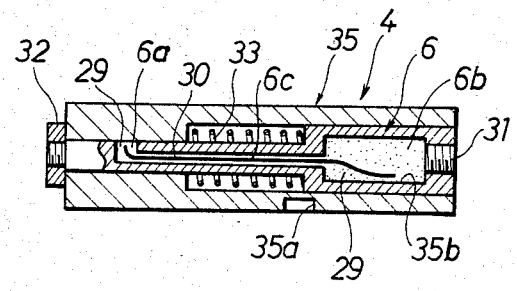
FIG. 3 is a sectional view showing a coloring device of an upper thread dyeing mechanism of the first embodiment.
Figure 4:
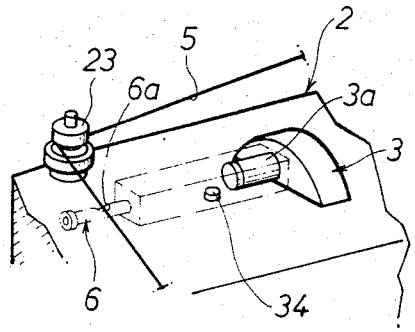
FIG. 4 is a perspective view showing a manner in which the coloring device is mounted on a sewing machine housing.

FIGS. 3 and 4 show the coloring device 4 of the dyeing mechanism. The coloring device 4 is formed up as a case 35 in which a laterally extending rod 6 is slidably received. The rod 6 has an enlarged hollow base 6b in which a felt 29 impregnated with a coloring liquid is contained, and a coloring section 6a which is a notched opening formed at the end thereof and connected to the base 6b by way of a conduit 6c. The coloring liquid is led from the base 6b to the coloring section 6a by way of a wick 30 positioned in the conduit 6c therebetween. A screw 31 is screwed into the rear end of the base 6b to close the same and the coloring liquid can be replenished therethrough. The rod 6 is normally held within the case 35 as shown in FIG. 3 by a compression spring 33 normally biasing the rod 6 in the rightward direction. Another screw 32 is secured to the end of the case 35 as a stopper for the rod 6. The screw 32 also functions to prevent evaporation of the coloring liquid when the coloring device is not used. The case 35 is provided at the bottom with a recess 35a. For installation of the coloring device 4 to the sewing machine, the device is mounted on an extending rod 3a of the mount 3 which is inserted into a cylindrical inner recess 35b of the case 35 against the action of the compression springs 33, and is secured to the rod 3a at a position wherein an upper spring-biased projection 34 provided on the machine housing 2 engages the recess 35a of the case 35. At this position of installation, the coloring section 6a of the rod 6 is projected from the case 35 for attaining a contact of the coloring liquid with the upper thread 5.

The first embodiment of the invention as described above is operated as follows.

Figure 7:
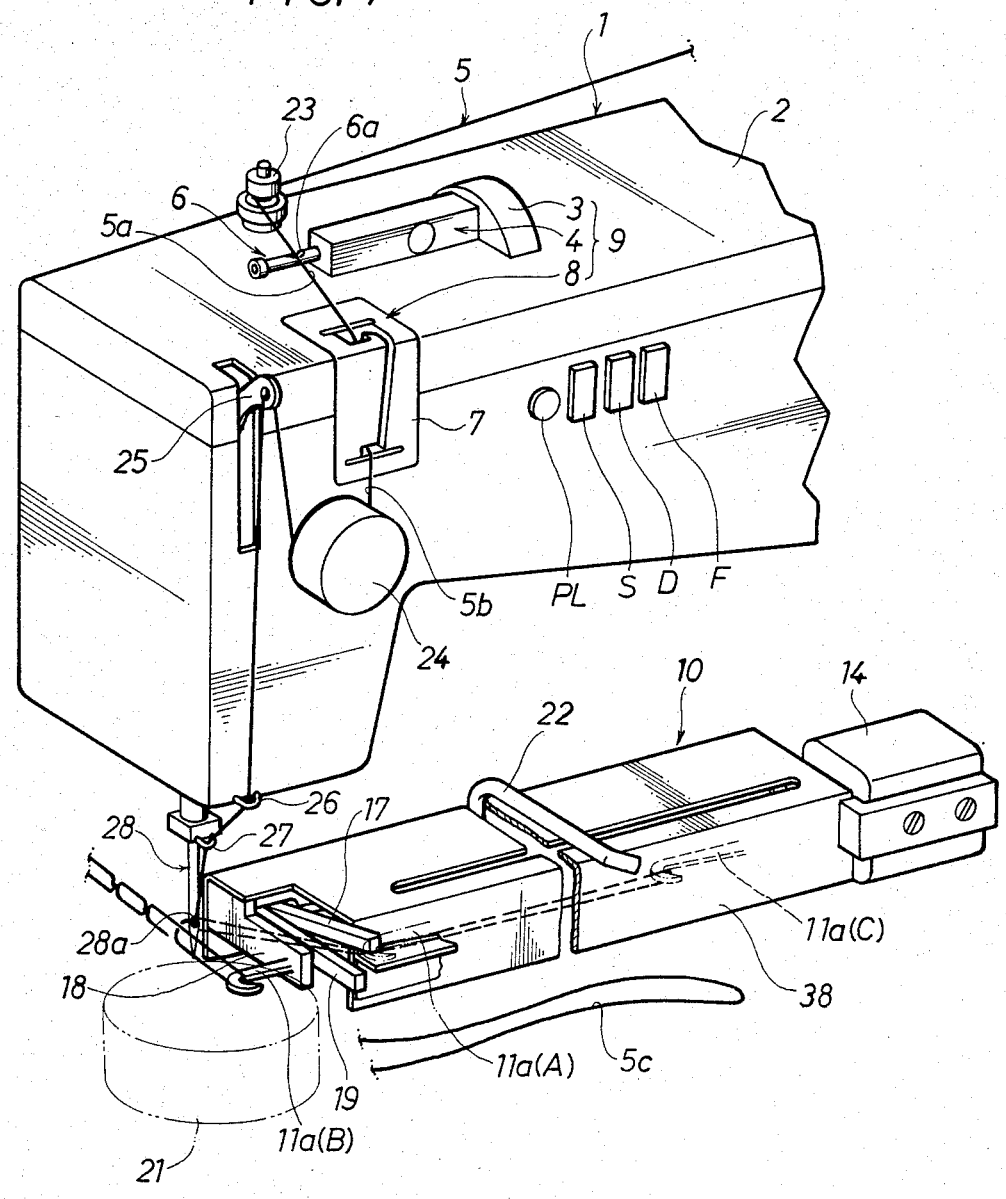
FIG. 7 is a diagrammatic view showing the sewing machine of the first embodiment, and specifically showing operation of the upper thread feeding mechanism thereof.
Figure 8:
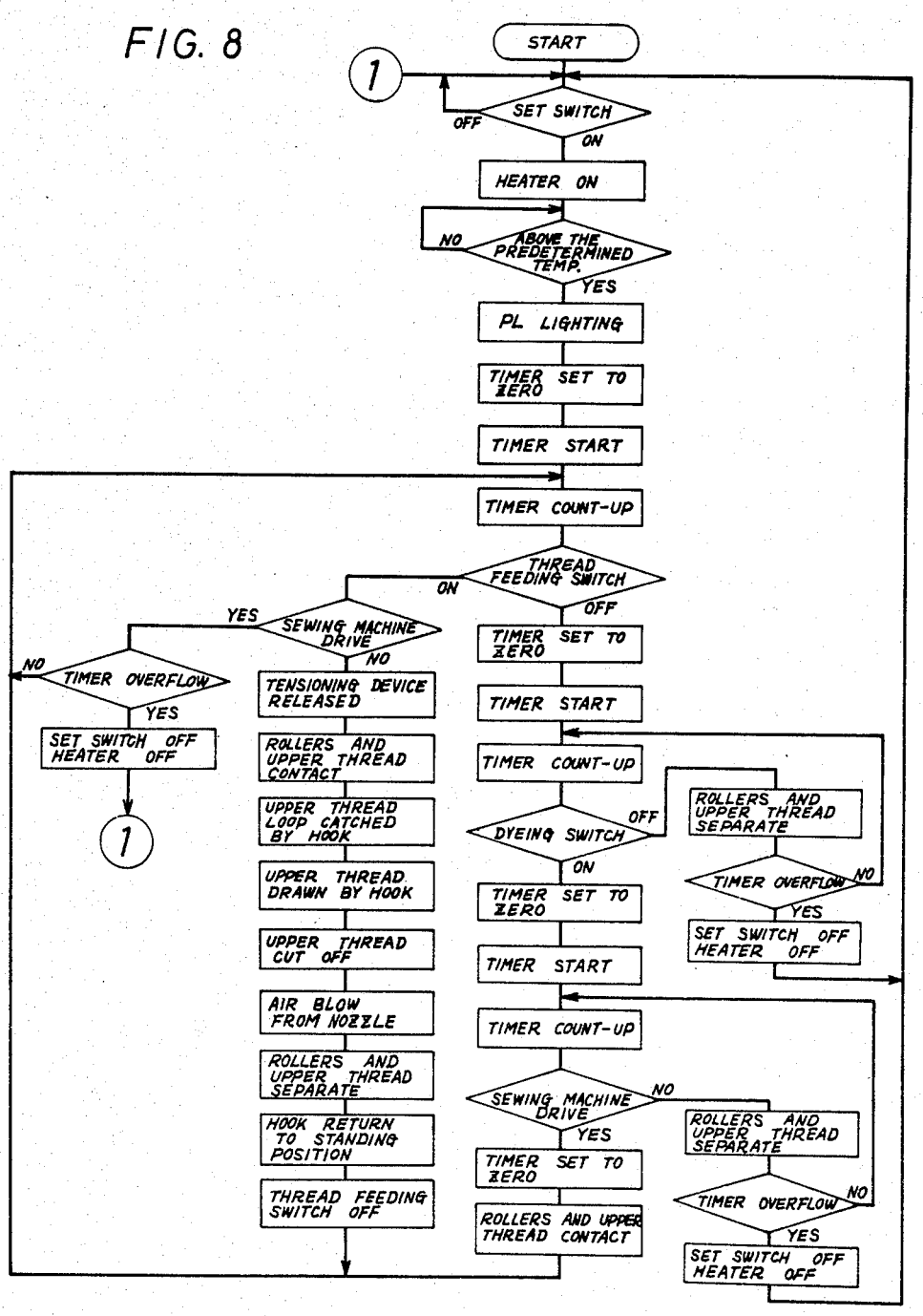
FIG. 8 is a flow chart showing operation of the sewing machine of the first embodiment.

In reference to FIGS. 2, 7 and 8, a white colored upper thread 5 is supplied from the thread supply (not shown) and located on the sewing machine 1, and is passed through a thread guide 23, the heat-set section 8, a thread tension device 24, a thread take-up lever 25, thread guides 26 and 27 and a needle hole 28a. Then, operation of the set button S will turn on the set switch, switch on the heater for heat-set rollers of the heat-set section 8, light the pilot lamp PL when the temperature of the rollers reaches a predetermined value, set a timer to zero and start the timer counting-up, in the order named.

Then, the coloring device 4 of an intended color is mounted to the mount 3 for attaining a contact between the coloring section 6a and the upper thread 5. On this condition, a test sample material is placed on a needle plate of the sewing machine 1, and then the thread feeding button F is operated to turn on the thread feeding switch, so as to make the thread tension device 24 ineffective (i.e., the thread 5 is released from the tension). To vertically reciprocate the needle 28 to stop the same at about the upper dead point after the upper thread 5 has been connected to the bobbin thread (not shown) located in the loop taker 21, while the upper thread 5 comes into contact with the heat-set rollers of the heat-set section 8. At the same time, the motor 14 is rotated in one direction to rotate the threaded shaft 15 in the same direction to thereby move the hook 11a from the inoperative position (A) to the advanced operative position (B) in the path between the two blades 17 and 19, where it catches the thread loop. Then, the motor 14 is rotated in the opposite direction to rotate the threaded shaft 15 in the same direction to thereby move back the hook 11a to the position (C), where the hook 11a draws out a predetermined amount of the thread from the thread supply to feed the same to the needle. In this position of the hook 11a, the block 12 carrying the hook 11a engages the downwardly extending arm 20a of the actuator 20 to turn the guide shaft 16 in the clockwise direction. The blade 17 is accordingly turned in the same direction and cooperates with the stationary blade 19 to cut off the drawn out thread 5*c*. Then, the cut-out portion of the thread 5 is blown off by the air discharged from the nozzle 22, and simultaneously the thread 5 is disengaged from the heat-set roller of the heat-set section 8. After the severance of the drawn-out thread 5*c*, the motor 14 is rotated again to move the hook 11*a* to the inoperative position (A). The thread feeding switch is now turned off and a series of thread feeding operation have been finished. The upper thread which remains to be located on the sewing machine after the thread feeding operation is colored with the intended color and is ready for stitching operation.

For starting the pattern stitching operation, the test sample material is replaced by a material to be sewn. The dyeing button D is pushed to turn on the dyeing switch, and thus the timer is set to zero. The timer then starts counting up. If the operation of the sewing machine is started within a predetermined count of the timer, the timer is again set to zero. As a result, the stitching operation starts and continues while continuously dyeing the upper thread by contact with the coloring device 4.

When it is required to change the color of the thread during the stitching operation, the sewing machine is stopped and the coloring device 4 is replaced by another suitable one so that the upper thread is brought into engagement with the coloring section 6*a* of the fresh coloring device 4. Then, the thread feeding switch is turned on by pushing the button F to carry out the sequential steps of the thread feeding operation as described above in detail.

The color changing operation according to the invention can be therefore carried out only by changing the coloring device 4, while the upper thread 5 is located on the sewing machine. The upper thread 5 having the extra part thus cut off is now colored with a new color and is ready for further stitching operation requiring the new color. When the dyeing button D is pushed to turn on the dyeing switch and the sewing machine is started to drive, the stitching operation is initiated and continues while continuously coloring the thread with the new color.

Figure 5:
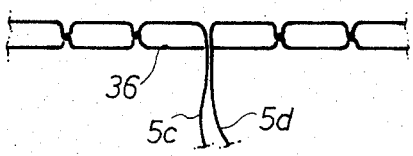
FIG. 5 is a longitudinal sectional view of a series of stitches produced by the sewing machine according to the first embodiment.

After completion of the stitching operation, the extra portions 5*c* and 5*d* of the upper thread, which remain the stitch after cutting-off operation as shown in FIG. 5, are removed by a scissor or the like.

Figure 6:
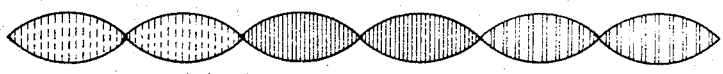
FIG. 6 is a diagrammatic view showing a colorful stitch pattern, by way of example, produced by the sewing machine according to the invention.

According to this embodiment of the invention, the pattern stitches or embroidery stitches requiring many different colors of the upper thread can be effectively sewn by a sewing machine, as shown in FIG. 6, which will require no preparation of many upper threads with different colors, and no resetting of upper thread on the sewing machine each time a different color is required for the stitches.

The first embodiment of the invention is provided with automatic control system for security and saving of energy. More particularly, the operator sometimes has to leave the sewing machine with the pilot lamp PL being lighted showing that the temperature of the heat-set roller of the heat-set section 8 has been raised to a predetermined value, but with both the thread feeding button F and the dyeing button D being not operated. In this condition, the upper thread is still separated from the heat-set roller. If this condition is kept for a predetermined time, timer overflows and automatically turns off the set switch and the heater.

Moreover, if the thread feeding switch is turned on while driving the sewing machine, a series of steps of the thread feeding operation are not performed so far as the sewing machine continues to drive. In this case, the timer overflows to turn off the set switch and the heater.

Furthermore, if the sewing machine is not started while the thread feeding switch is off and the dyeing switch is on, the upper thread is separated from the heat-set roller and the timer overflows to automatically turns off the set switch and the heater.

The second embodiment of the invention shown in FIGS. 9–13 has substantially the same construction and functions as the first embodiment, but has a different thread feeding mechanism. The corresponding parts and elements of the second embodiment are accompanied with the numerals to those of the first embodiment.

Figure 9:
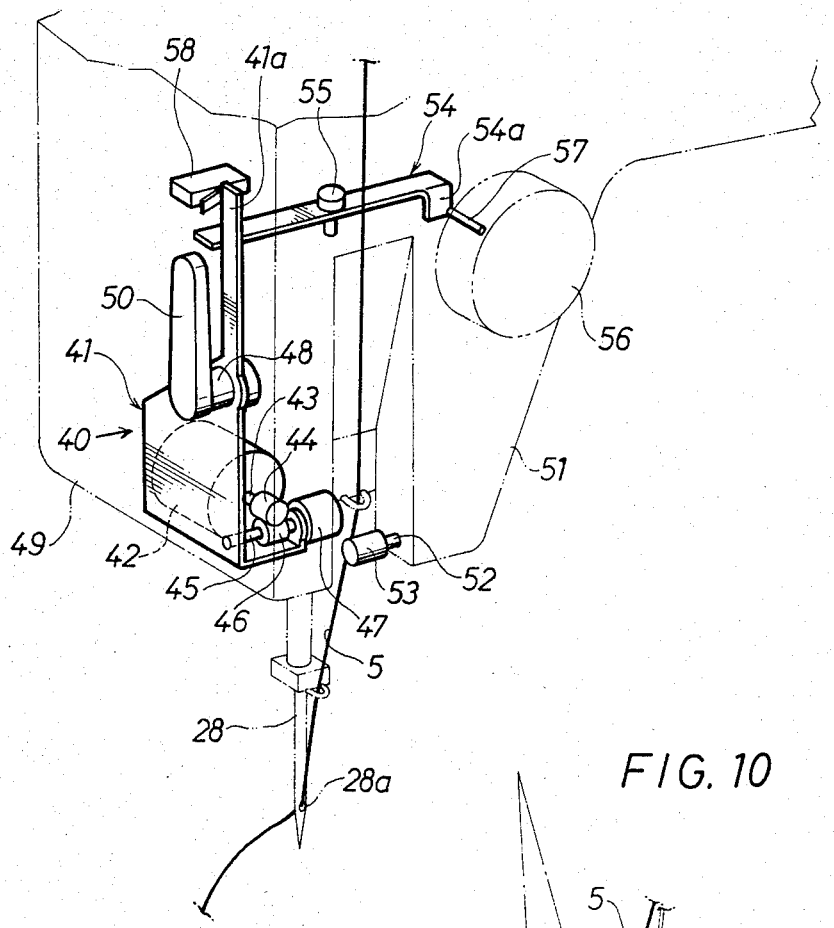
FIG. 9 is a perspective view substantially showing an upper thread feeding mechanism provided for a sewing machine according to a second embodiment of the invention.
Figure 10:
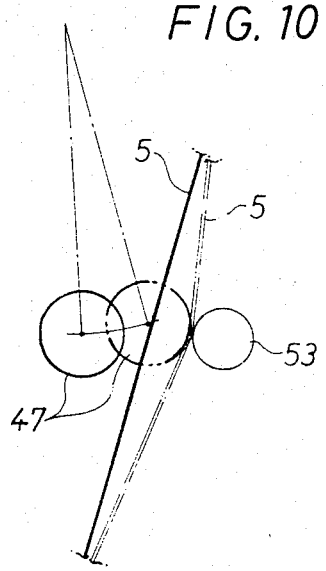
FIG. 10 is a diagrammatic view showing positional relationship between an upper thread and an upper thread feeding roller of the feeding mechanism shown in FIG. 9.

Referring specifically to FIG. 9, a motor 42 is secured to a base plate 41 of a thread feeding mechanism 40 of the second embodiment. To a shaft 43 of the motor 42 is secured a gear 44 which engages another gear 46 which is secured to a shaft 45 rotatably supported on the base plate 41. The gear 46 is thus rotated by the motor 42 and rotates a roller 47 of elastic material secured to the shaft 45. The base plate 41 has a stud 48 by which the base plate 41 is turnably mounted on a face plate 49. A lever handle 50 is secured to the stud 48 and is located outside of the face plate 49. To a machine housing 51 is secured a shaft 52 on which a roller 53 of elastic material is rotatably mounted in a position opposite to the roller 47. A tension loosening lever 54 is turnably mounted on a pivot 55 secured to the housing 51. When the lever handle 50 is turned on the counterclockwise direction (as viewed in FIG. 9), the base plate 41 is turned in the same direction and a upper portion 41*a* of the base plate 41 turns the tension loosening lever 54 in the clockwise direction. As a result, a downwardly extending surface 54*a* of the lever 54 actuates a thread loosening pin 57 of a tensioning device 56 to thereby loosen the tension applied to the upper thread 5. At the same time, the roller 47 is turned about the stud 48 in the counterclockwise direction together with the rotation of the base plate 41 and comes into contact with the roller 53 to thereby press the upper thread between the two rollers 47 and 53, as shown in FIG. 10. With the clockwise turning movement of the lever 54, a thread feeding switch 58 is turned on to energize the motor 42 to rotate the roller 47, thereby drawing out a predetermined amount of the upper thread from the thread supply to feed the same to the needle 28. Although not specifically shown in the drawings, a locking device is provided for the thread feeding lever 50 for preventing the same from being moved when the sewing machine is driving.

The second embodiment as described above is operated as follows. More particularly, for dyeing operation, a white colored upper thread 5 is located on a sewing machine, the set button S is pushed to turn on the set switch and lighten the pilot lamp PL. Then, the coloring device 4 producing an intended color is mounted on the mount 3 for achieving a contact between the coloring section 6*a* and the upper thread 5, substantially in the same manner as in the operation of the first embodiment.

Figure 11:
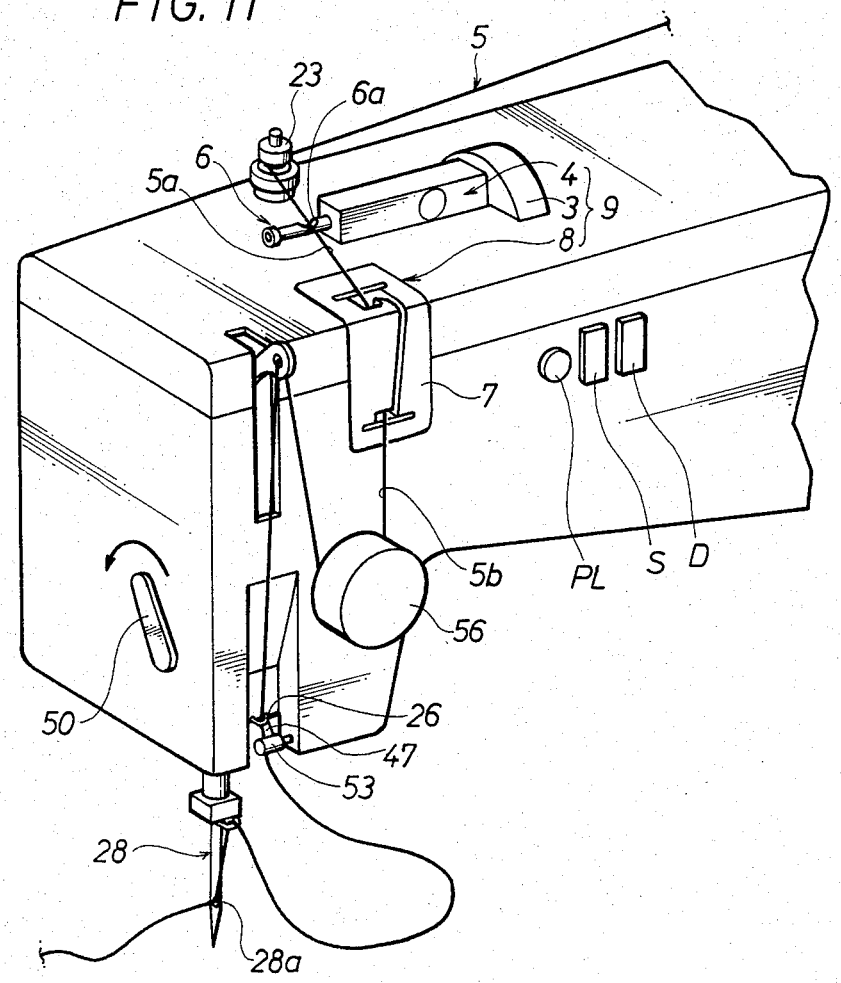
FIG. 11 is a perspective view showing the sewing machine provided with the upper thread feeding mechanism according to the second embodiment.
Figure 13:
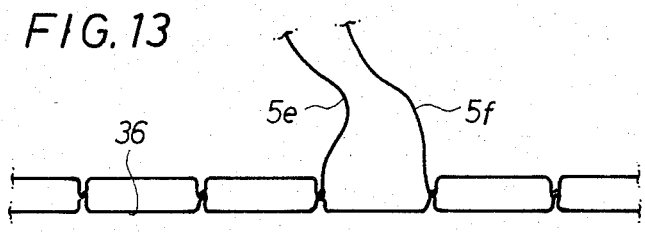
FIG. 13 is a longitudinal sectional view of a series of stitched produced by the sewing machine according to the second embodiment.
Figure 12:
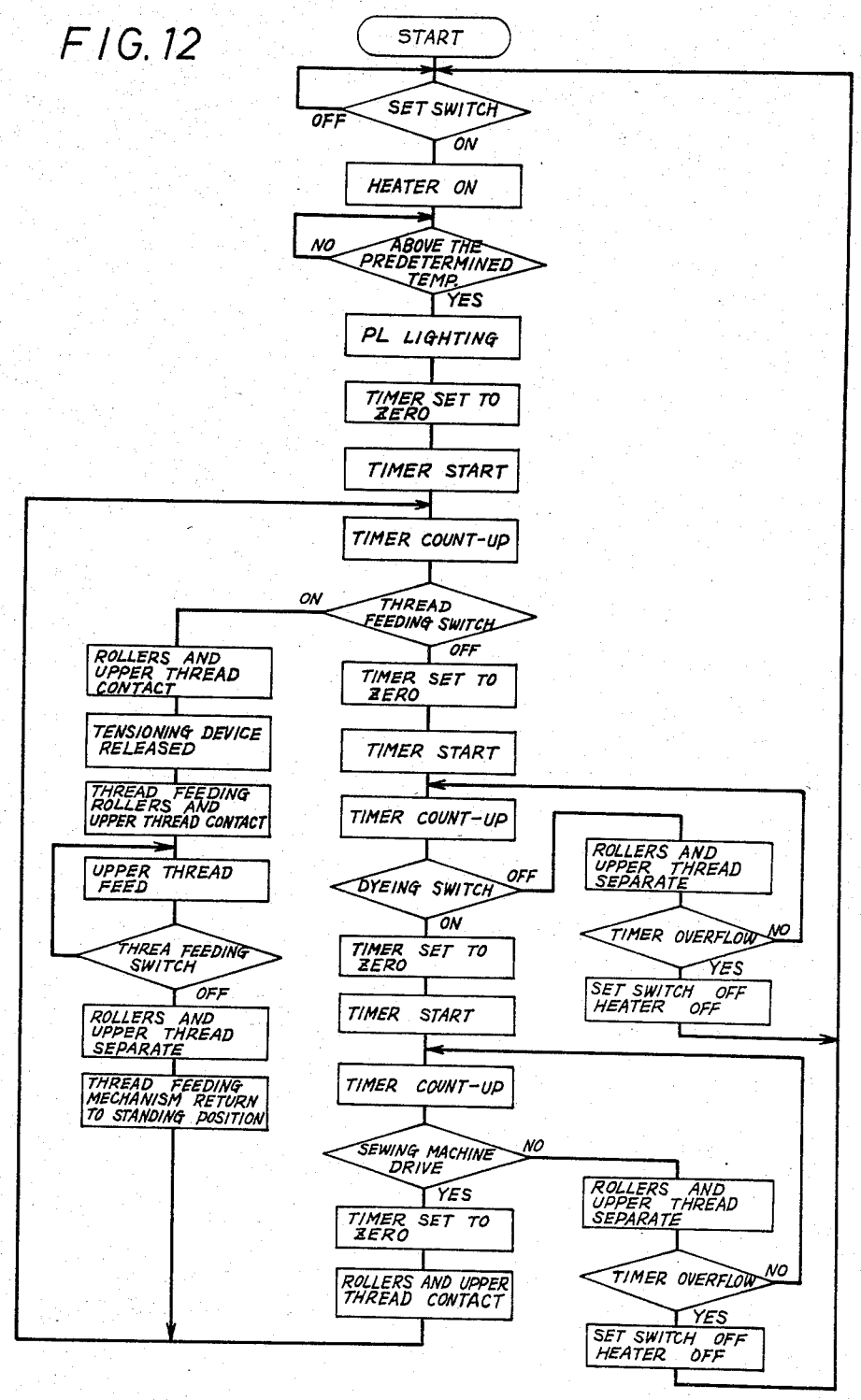
FIG. 12 is a flow chart showing operation of the sewing machine of the second embodiment.

When the lever handle 50 is thereafter turned in the counterclockwise direction, the thead feeding switch 58 will be turned on, only when the sewing machine is not driving. Sequentially, the heat-set roller comes into contact with the upper thread 5, the motor 42 starts driving, the thread tension device 58 is made ineffective, and then the upper thread 5 is fed by passing between the rollers 47 and 53 while being colored with a desired color. After applying a dyeing treatment to a given amount of the upper thread, the lever handle 50 is made free so that the upper thread is separated from the heat-set roller and the thread feeding mechanism 40 is returned to the inoperative position shown in FIG. 9. At this time, the given amount of the upper thread which has been colored with a desired color is slackened between the roller 53 and the needle hole 28*a*, as shown in FIG. 11. All the slack is pulled out of the thread as shown in FIG. 9, and some amount of the forward portion of the thread which remains to be white colored is cut away from the colored portion of the thread. The remaining portion of the thread which is located on the sewing machine and is passed through the needle hole 28*a* is thus ready for stitching operation.

For starting the stitching operation, a material to be sewn is placed on a needle plate. The dyeing button D is pushed to turn on the dyeing switch, and then the timer is set to zero. The timer is then started counting up, and when the sewing machine is started driving within a predetermined count of the timer, the timer is again set to zero. As a result, stitching operation starts and continues while continuously dyeing the upper thread with a given color.

When it is required to change the color of the upper thread during the stitching operation, the sewing machine is stopped driving, and the previously used coloring device 4 is replaced by another suitable one, while the upper thread remains to be located on the sewing machine. Then, the thread feeding switch 58 is turned on by operation of the lever handle 50, so that some amount of the upper thread is fed by passing between the two rollers 47 and 58 while being colored with a new color. When the lever handle 50 is thereafter made free to return the thread feeding mechanism 40 to the inoperative position shown in FIG. 9, the thread feeding switch 58 is turned off and the thread is separated from the heat-set roller. The color changing operation is now completed. The upper thread slackened as shown in FIG. 11 is tightened and some amount of the forward portion of the thread which is colored with a previous color is cut off.

After completion of the color changing operation, the dyeing button D is pushed to turn on the dyeing switch and the sewing machine is started driving. Then, the stitching operation starts and continues while continuously coloring the upper thread with the new color.

According to this embodiment of the invention, as well as the first embodiment, colorful stitches can be easily made with a sewing machine. Excessive portions 5*e* and 5*f* of the upper thread which still remain in the stitch after the thread is cut off, is cut away from the completed stitch.

The second embodiment of the invention is also provided with automatic control system for security and saving of energy, similar to that of the first embodiment. More particularly, if an operator should leave the sewing machine while the pilot lamp PL is lightened, with the lever handle 50 and the dyeing button D being not yet operated, the upper thread still remains to separate from the heat-set roller. Accordingly, when this condition is kept for a predetermined period of time, the timer overflows to turn off the set switch and the heater.

Moreover, if the thread feeding switch is turned on while driving the sewing machine, a series of the thread feeding operation will not be performed so far as the sewing machine continues driving. In this case, the timer overflows to turn off the set switch and the heater.

Furthermore, if the sewing machine is not driven while the thread feeding switch is off whereas the dyeing switch is on, the upper thread is separated from the rollers and the timer overflows to turn off the set switch and the heater.

Although the upper thread is fed by the motor in the embodiments above-described, the thread feeding mechanism of the invention may be modified such that the upper thread is manually fed.

Although the invention has been shown and described in terms of preferred embodiments thereof, it should be understood that many changes and modifications will be obvious to one skilled in the art without departing from the true spirit and scope of the invention as defined in the appended claims.

What is claimed is:

1. A sewing machine having a needle carrying an upper thread and a thread tension for normally applying a predetermined tension to the upper thread, said sewing machine comprising an upper thread dyeing mechanism for dyeing the upper thread with any color or any combination of different colors; an upper thread feeding mechanism operated to draw away from the needle a predetermined amount of the upper thread existing between said dyeing mechanism and said needle; and a switch connected to said tension device and to said feeding mechanism, said switch being operated to inactivate said thread tension device to release said tension from the upper thread and simultaneously operate said feeding mechanism, said dyeing mechanism being located a predetermined distance from said needle and being operative not only when the sewing machine is in stitching operation but also when said feeding mechanism is operated, whereby after completion of the operation of said feeding mechanism a segment of the upper thread having a desired color is properly positioned at a location in the pattern in which said segment is to appear.

2. The sewing machine as claimed in claim 1 wherein said thread feeding mechanism comprises a hook adapted to catch the upper thread and draw out the same away from a reciprocating needle, means for cutting off the upper thread which is drawn away from the needle by said hook, and a nozzle for blowing air to remove the cut-off portion of the upper thread.

3. The sewing machine as claimed in claim 2 wherein said hook engages a rotatable threaded shaft extending laterally away from the needle, and said means for moving said hook comprises a rotating member for rotating said thread shaft.

4. The sewing machine as claimed in claim 1 wherein said upper thread feeding mechanism comprises a motor driven by said switch, a first roller of resilient material connected to said motor to be rotated thereby, a second roller of resilient material freely rotatable about an axis secured to a machine housing, an operating handle operated to establish a contact between said first and second rollers, thereby feeding the upper thread by passing therebetween.

* * * * *